US010796840B2

(12) United States Patent
Ryu et al.

(10) Patent No.: US 10,796,840 B2
(45) Date of Patent: Oct. 6, 2020

(54) COIL COMPONENT

(71) Applicant: SAMSUNG ELECTRO-MECHANICS CO., LTD., Suwon-Si, Gyeonggi-Do (KR)

(72) Inventors: Joung Gul Ryu, Suwon-Si (KR); Boum Seock Kim, Suwon-Si (KR); Kang Wook Bong, Suwon-Si (KR); Byeong Cheol Moon, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 223 days.

(21) Appl. No.: 16/027,947

(22) Filed: Jul. 5, 2018

(65) Prior Publication Data

US 2019/0180905 A1 Jun. 13, 2019

(30) Foreign Application Priority Data

Dec. 7, 2017 (KR) ..... 10-2017-0167357

(51) Int. Cl.

| | |
|---|---|
| ***H01F 27/32*** | (2006.01) |
| ***H01F 27/06*** | (2006.01) |
| ***H01F 27/28*** | (2006.01) |
| ***H01F 27/255*** | (2006.01) |

(Continued)

(52) U.S. Cl.

CPC ..... *H01F 27/06* (2013.01); *H01F 17/0013* (2013.01); *H01F 17/04* (2013.01);

(Continued)

(58) Field of Classification Search

CPC .... H01F 27/06; H01F 27/2804; H01F 27/255; H01F 27/29; H01F 27/323; H01F 27/324;

(Continued)

(56) References Cited

U.S. PATENT DOCUMENTS

2014/0009254 A1* 1/2014 Ohkubo ..... H01F 27/29 336/192
2014/0145812 A1* 5/2014 Lee ..... H01F 41/041 336/200

(Continued)

FOREIGN PATENT DOCUMENTS

| | | | |
|---|---|---|---|
| JP | S59-151411 | U | 10/1984 |
| JP | 2001-189215 | A | 7/2001 |
| KR | 10-1999-0066108 | A | 8/1999 |
| KR | 10-2007-0077925 | A | 7/2007 |
| KR | 10-2016-0149447 | A | 12/2016 |

OTHER PUBLICATIONS

Japanese Office Action dated Nov. 13, 2018 issued in Japanese Patent Application No. 2018-131180 (with English translation).

*Primary Examiner* — Mang Tin Bik Lian
(74) *Attorney, Agent, or Firm* — Morgan, Lewis & Bockius LLP

(57) ABSTRACT

A coil component includes: a body including a support member, a coil, and a magnetic material; and external electrodes disposed on an external surface of the body. The coil may include first and second coils supported by one surface and the other surface of the support member, respectively, and the first and second coils may include first and second seed patterns, respectively. A thickness of the first seed pattern may be thinner than that of the second seed pattern. Warpage properties of the first support member adjacent to the first seed pattern may be greater than those of the second support member adjacent to the second seed pattern.

18 Claims, 4 Drawing Sheets

(51) Int. Cl.
*H01F 27/29* (2006.01)
*H01F 17/00* (2006.01)
*H01F 17/04* (2006.01)

(52) U.S. Cl.
CPC ..... *H01F 27/255* (2013.01); *H01F 27/2804* (2013.01); *H01F 27/29* (2013.01); *H01F 27/292* (2013.01); *H01F 27/324* (2013.01); *H01F 2017/002* (2013.01); *H01F 2017/048* (2013.01); *H01F 2027/2809* (2013.01)

(58) Field of Classification Search
CPC ..... H01F 2027/2809; H01F 17/04; H01F 17/0013; H01F 2017/048; H01F 2017/0073; H01F 2017/002
USPC ..... 336/200, 223, 233
See application file for complete search history.

(56) References Cited

U.S. PATENT DOCUMENTS

2014/0285304 A1* 9/2014 Yoo ..... H01F 41/046 336/200
2015/0035634 A1* 2/2015 Nakamura ..... H01F 41/046 336/170
2015/0048918 A1* 2/2015 Park ..... H01F 17/0013 336/200
2015/0170823 A1 6/2015 Jeong et al.
2015/0340150 A1* 11/2015 Nakamura ..... H01F 17/0013 336/200
2016/0086721 A1* 3/2016 Park ..... H01F 41/042 336/200
2016/0374198 A1 12/2016 Kim et al.

* cited by examiner

COIL COMPONENT

CROSS-REFERENCE TO RELATED APPLICATION(S)

This application claims benefit of priority to Korean Patent Application No. 10-2017-0167357 filed on Dec. 7, 2017 in the Korean Intellectual Property Office, the disclosure of which is incorporated herein by reference in its entirety.

TECHNICAL FIELD

The present disclosure relates to a coil component, and more particularly, to a thin-film type power inductor.

BACKGROUND

In accordance with the development of information technology (IT), apparatuses have rapidly been miniaturized and thinned. Therefore, market demand for small, thin devices has increased.

Korean Patent Laid-Open Publication No. 10-1999-0066108 provides a power inductor including a substrate having a via hole and coils disposed on opposite surfaces of the substrate and electrically connected to each other through the via hole of the substrate in accordance with such a technical trend to make an effort to provide an inductor including coils having uniform and high aspect ratios. However, there is still a limitation in forming coils having uniform and high aspect ratios, due to a limitation in a manufacturing process.

SUMMARY

An aspect of the present disclosure may provide a coil component capable of increasing a thickness of a coil by thinning a core while maintaining an overall thickness of a core of a copper clad laminate (CCL) substrate according to the related art so as to use equipment facilities as they are, and capable of preventing warpage of the core in spite of thinness of the core.

According to an aspect of the present disclosure, a coil component may include: a body including a support member including a through-hole filled with a magnetic material and a via hole filled with a conductive material, and containing an insulating material; a coil including a first coil disposed on one surface of the support member and a second coil disposed on the other surface of the support member opposing the one surface thereof; and the magnetic material encapsulating the support member and the coil; and external electrodes disposed on an external surface of the body and connected to the coil. The first and second coils may include first and second seed patterns coming into contact with the support member, respectively, and a thickness of the first seed pattern may be thinner than that of the second seed pattern. The support member may include a first support member including one surface of the support member and a second support member including the other surface of the support member. Warpage properties of the first support member may be greater than those of the second support member.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil component according to an exemplary embodiment in the present disclosure, and a method of manufacturing the same will be described, but are not necessarily limited thereto.

Coil Component

Figure 1:
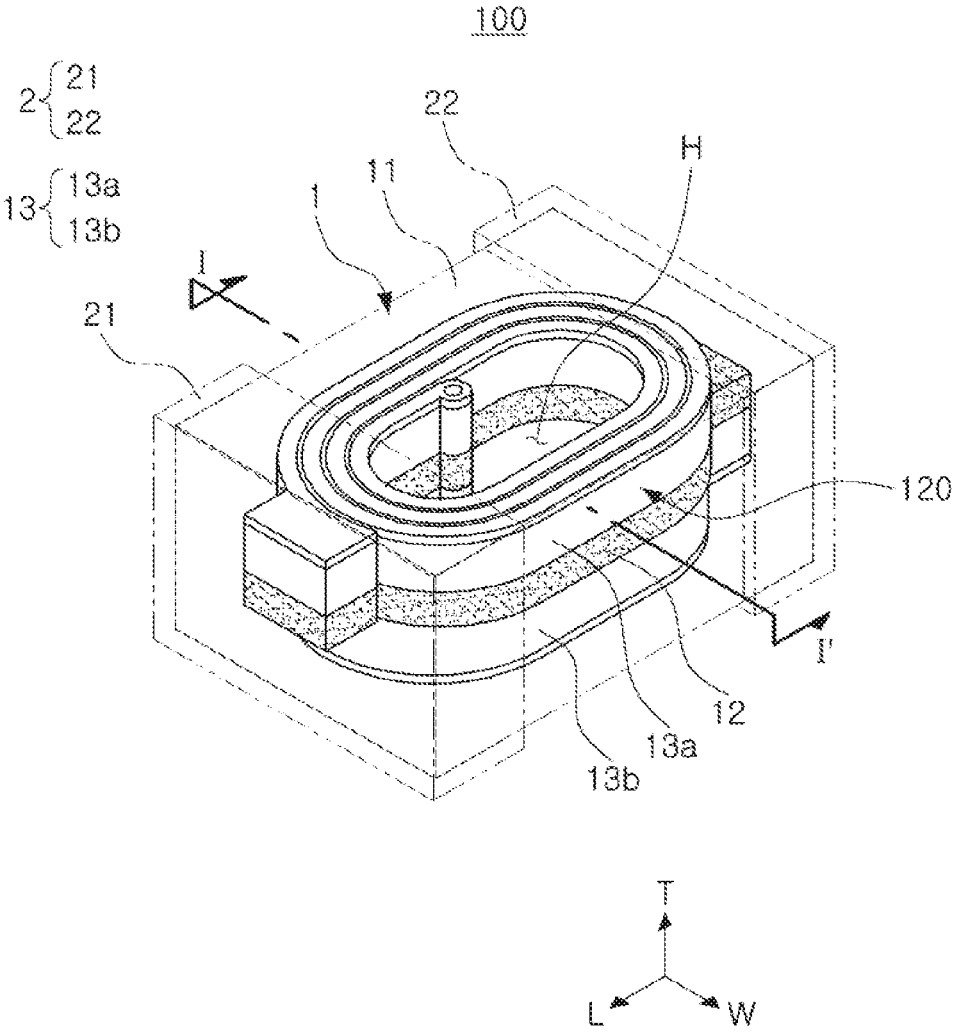
FIG. 1 is a schematic perspective view of a coil component according to an exemplary embodiment in the present disclosure.
Figure 2:
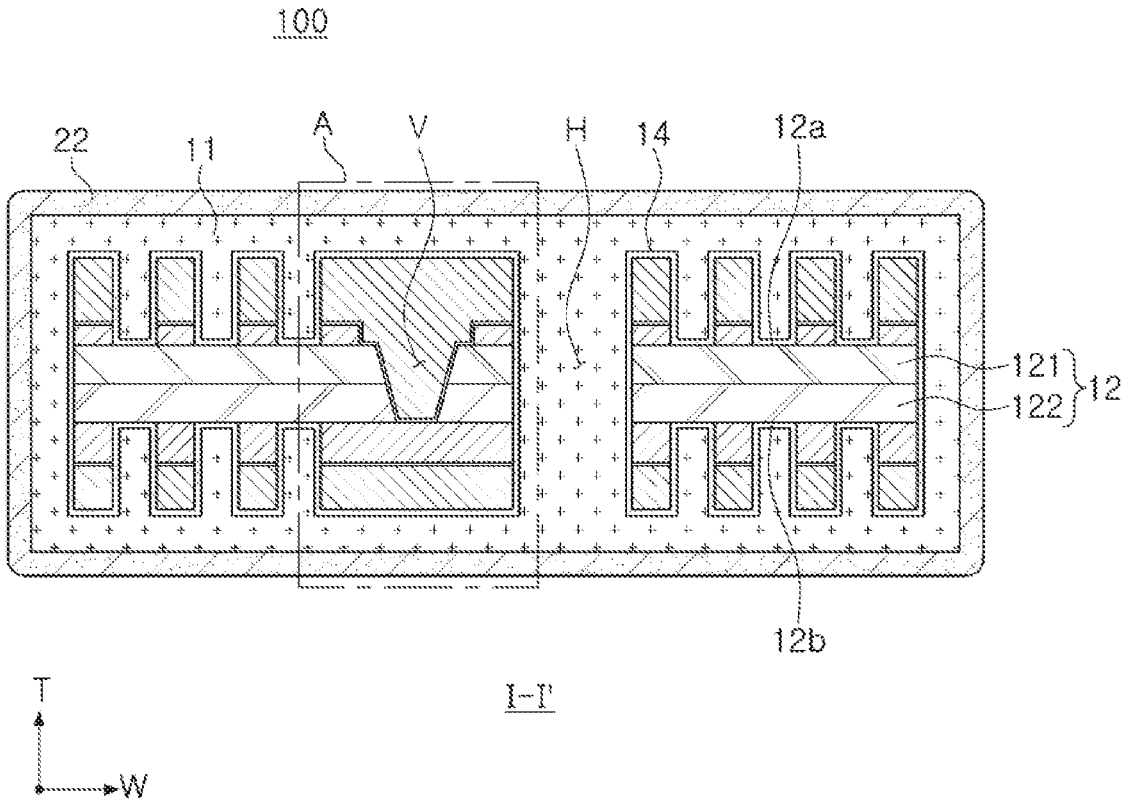
FIG. 2 is a schematic cross-sectional view taken along line I-I' of FIG. 1.
Figure 3:
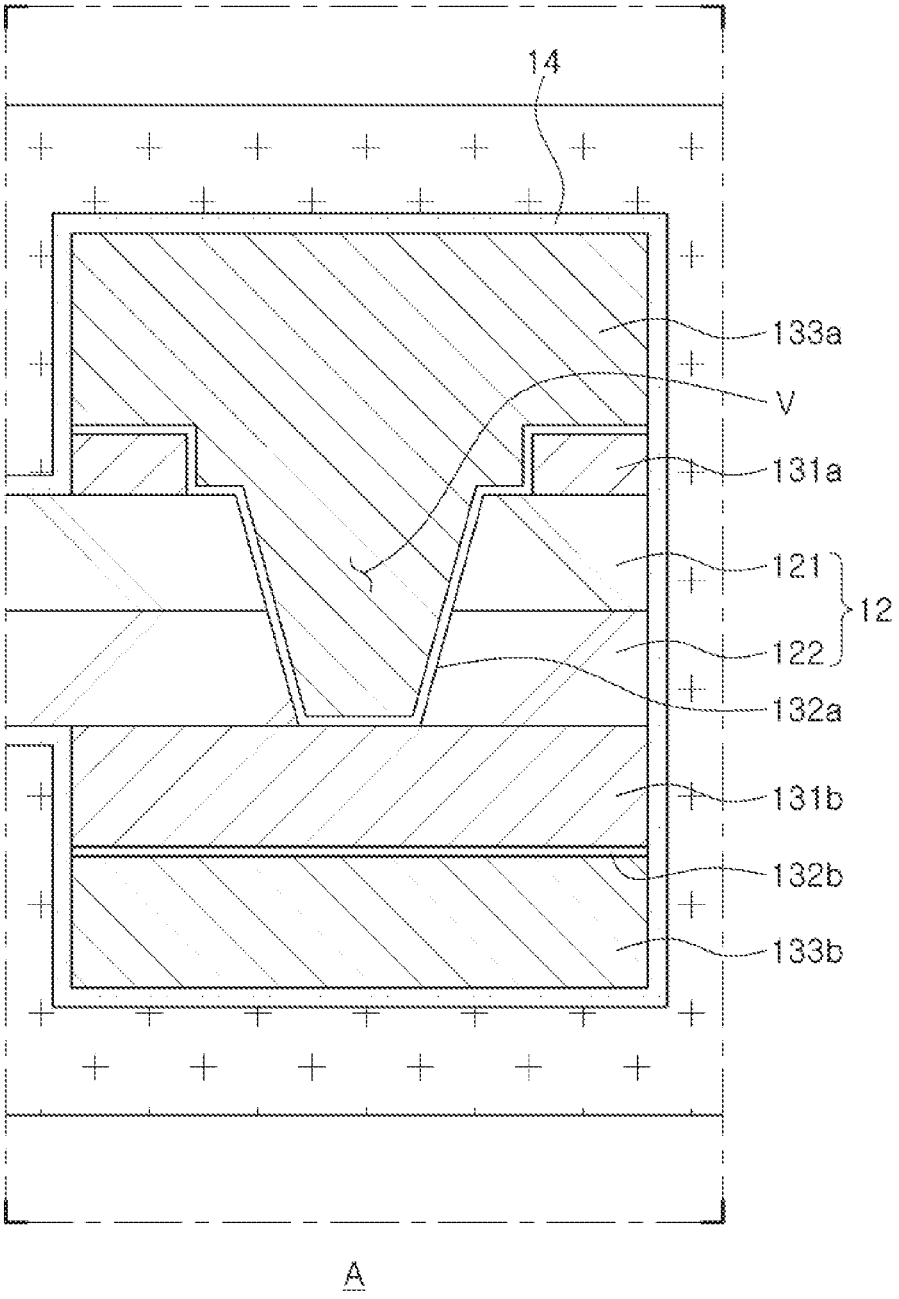
FIG. 3 is an enlarged view of part A of FIG. 2.

FIG. 1 is a schematic perspective view of a coil component 100 according to an exemplary embodiment in the present disclosure, FIG. 2 is a cross-sectional view taken along line I-I' of FIG. 1, and FIG. 3 is an enlarged view of part A of FIG. 2.

Referring to FIGS. 1 through 3, the coil component 100 may include a body 1 and external electrodes 2. The external electrodes 2 may include first and second external electrodes 21 and 22 connected to different polarities from each other.

The body 1 may form an exterior of the coil component, have upper and lower surfaces opposing each other in a thickness (T) direction, first and second end surfaces opposing each other in a length (L) direction, and first and second side surfaces opposing each other in a width (W) direction, and have a substantially hexahedral shape.

The body 1 may contain a magnetic material 11. As the magnetic material 11, any material may be used as long as it has magnetic properties. For example, the magnetic material 11 may be ferrite or a material in which metal magnetic particles are filled in a resin. The metal magnetic particle may contain one or more selected from the group consisting of iron (Fe), silicon (Si), chromium (Cr), aluminum (Al), and nickel (Ni).

The magnetic material 11 may encapsulate a support member 12 to be described below and a coil 13 supported by the support member 12.

Since the support member 12 serves to support the coil 13, the support member 12 needs to have rigidity suitable for stably supporting the coil. The support member 12 may include a through-hole H filled with the magnetic material, and a via hole v formed in the vicinity of the through-hole H to be spaced apart from the through-hole H and filled with a conductive material. The support member 12 needs to be thinned for a low-profile coil component. As a generally used support member, a central core of a copper clad laminate (CCL) substrate known in the art has a thickness of substantially 60 μm. However, recently, the demand for a thinner substrate has increased. However, the substrate is thinned, which is effective in manufacturing the low-profile coil component, but it may be difficult to handle the thinned substrate during a process, and a risk that deformation such as warpage, or breakage, or the like, will occur may be increased. Further, when an overall thickness of the support member is thinned, there is a need to change equipment or a driving method in a mass production line according to the related art. Therefore, there is a need to significantly decrease a change in existing equipment facilities and a handling problem caused by thinness while thinning the support member.

Therefore, the support member 12 of FIGS. 1 through 3 may have a thickness thinner than that of the central core of the CCL substrate known in the art, such that a distance between a coil pattern on an upper surface of the support member and a coil pattern on a lower surface of the support member may be decreased, and a difficult in handing at the time of forming the coil pattern may be significantly decreased. A thickness of the support member 12 may be 35 μm to 65 μm, and more preferably about 40 μm. When the thickness of the support member is thinner than 35 μm, it may be significantly difficult to handle the support member, and it may be difficult to secure rigidity for supporting a coil pattern having a high aspect ratio, and when the thickness of the support member is thicker than 65 μm, the support member does not suitably correspond to the low-profile coil component.

The support member 12 may have one surface 12*a* and the other surface 12*b* opposing each other in the thickness direction. The support member 12 may include a first support member 121 including one surface 12*a* and a second support member 122 including the other surface 12*b*, and have a stacking structure in which the first support member 121 is stacked on the second support member 122.

The first and second support members 121 and 122 may have different warpage properties. In order to use existing equipment facilities without change, there is a need to maintain the thickness of the CCL substrate known in the art. To this end, carrier foil removed in a final product may be used. The carrier foil may be an auxiliary configuration for reinforcing a thin thickness when a total thickness of the support member and first and second seed patterns attached to one surface and the other surface of the support member is thinner than the thickness of the CCL substrate known in the art. Meanwhile, since thicknesses of the first and second seed patterns formed on one surface and the other surface of the support member are different from each other, the carrier foil may be stacked preferably on the first seed pattern, which is a seed pattern having a thinner thickness. Here, there is a need to remove the carrier foil during the process, and a problem that the support member is warped in one direction during removing the carrier foil may occur. However, since the support member 12 of the coil component according to the present disclosure has a structure in which the first and second support members 121 and 122 having different warpage properties are adhered to each other, the problem that the support member is warped in one direction during removing the carrier foil may be prevented. More specifically, the first seed pattern has a thinner thickness as that of the second seed pattern, the support member may be warped toward the second seed pattern, but since the warpage properties of the first support member coming into contact with the first seed pattern are larger than those of the second support member coming into contact with the second seed pattern, warpage of the support member toward the second seed pattern having a thicker thickness may be prevented.

In this case, as one of the methods of differentiating the warpage properties from each other, coefficients of thermal expansion (CTE) of insulating materials contained in each of the first and second support members 121 and 122 may be different from each other. More specifically, referring to FIGS. 1 through 3, a coefficient of thermal expansion (CTE) of a material contained in the first support member 121 may be larger than that of a material contained in the second support member 122. In this case, occurrence of warpage toward the second support member 122 having a relatively low coefficient of thermal expansion may be prevented.

The first and second support members 121 and 122 may basically contain an epoxy resin, and suitably contain polytetrafluoroethylene (PTFE), Polyimide (PI), liquid crystal polyester (LCP), thermoplastic epoxy, or thermosetting epoxy, which has an insulating rein having a different CTE, in the epoxy resin. For example, since generally, the coefficient of thermal expansion (CTE) of the epoxy resin is about 50-80 ppm/° C., and the epoxy resin has a CTE relatively larger than that of a material (for example, a metal or ceramic material, or the like) generally used in an electronic product, an insulating resin such as ester, amide, or the like, having a relatively low CTE than that of the epoxy resin may be further added to a material based on the epoxy resin in the second support member 122, but the material of the second member 122 is not limited thereto. Any material may be used without limitation as long as it has a low CTE and insulation properties.

Thicknesses of the first and second support members may be suitably selected in a range in which an overall thickness of the support member 12 is maintained, and the thicknesses of the first and second support members 121 and 122 may also be the same as each other. The thicknesses of the first and second support members 121 and 122 may be suitably selected depending on a difference in CTE between the first and second support members.

The coil 13 may be supported by the support member 12, and include a first coil 13*a* disposed on one surface of the support member 12 and a second coil 13*b* disposed on the other surface of the support member 12. The first and second coils 13*a* and 13*b* may include the first and second seed patterns 131*a* and 131*b*, first and second base layers 132*a* and 132*b*, and first and second plating layers 133*a* and 133*b*, respectively.

The first seed pattern 131*a* may be disposed on the first support member 121. The first seed pattern 131*a* may be entirely formed in a shape corresponding to a shape of the first coil 13*a*. The thickness of the first seed pattern 131*a* is not limited but needs to be thinner than that of the second seed pattern 131*b*. For example, the first seed pattern 131*a* may have a thickness of 2 μm or more to 5 μm or less. The reason is that it may be easy to pattern the first seed pattern 131*a* using a $CO_2$ laser in the above-mentioned thickness range.

The first seed pattern 131*b* may contain a material having excellent electrical conductivity, for example, a Cu alloy.

The second seed pattern 131*b* may be disposed on the second support member 122. The second seed pattern 131*b* may have an entirely coil shape similarly to the first seed pattern 131*a* but unlike the first seed pattern 131*a*, the second seed pattern 131*b* may be disposed at a position lower than the via hole v. In more detail, the first and second seed patterns 131*a* and 131*b* may form lowermost layers of a coil composed of a plurality of layers in a state in which they are disposed on one surface and the other surface of the support member 12, respectively. Here, the second seed pattern 131*b* may serve as a via pad of the via hole v formed in the support member 12. Therefore, the second seed pattern 131*b* may have a thickness of preferably 12 μm or more to 18 μm or less as a thickness enough to serve as the via pad.

A total thickness of the support member 12 and the first and second seed patterns 131*a* and 131*b* coming into contact with the support member while being supported by the support member may be controlled to be substantially equal or similar to that of the CCL substrate (having a stacking structure of a central core and copper foil formed on both surfaces of the central core) known in the art so as to use existing equipment facilities as they are. For example, the total thickness may be preferably in a range of 35 μm or more to 65 μm or less.

First and second base layers 132*a* and 132*b* may be disposed on the first and second seed patterns 131*a* and 131*b*, respectively. The first and second base layers 132*a* and 132*b* may be metal thin film layers and have a thickness of about 1 μm or less. A method of forming the first and second base layers 132*a* and 132*b* is not limited, but in a case of using a sputtering method, it may be easy to uniformly form a thin base layer. The first and second base layers 132*a* and 132*b* may contain a conductive material. For example, one or more of Mo, Al, Ti, Ni, and W may be used.

The first base layer 132*a* disposed on the first seed pattern may be formed to enclose a lower surface of the via hole v, and a lower surface of the first base layer 132*a* disposed on the lower surface of the via hole v may come in contact with the second seed pattern 131*b*. The first base layer 132*a* may be formed on side surfaces of the via hole v as well as the lower surface of the via hole v.

First and second plating layers 133*a* and 133*b* may be disposed on the first and second base layers 132*a* and 132*b*, respectively, and the first and second plating layers 133*a* and 133*b* are conductor layers substantially determining an aspect ratio of the coil. Line widths of the first and second plating layers 133*a* and 133*b* may be substantially equal to those of the first and second base layers 132*a* and 132*b* disposed below the first and second plating layers 133*a* and 133*b*. This structure may be derived by a method of forming the first and second base layers 132*a* and 132*b*, patterning insulating patterns, and filling the first and second plating layers 133*a* and 133*b* in opening portions of the insulating patterns.

The first and second plating layers 133*a* and 133*b* may contain an electrical conductive material suitable for a plating method, for example, a Cu alloy.

An insulating layer 14 may be disposed in order to insulate a surface of the coil and the magnetic material from each other. The insulating layer 14 may be formed of a material having excellent processability and insulation properties while having a uniform and thin thickness. For example, the insulating layer may be formed by a chemical vapor deposition (CVD) method.

Figure 4:
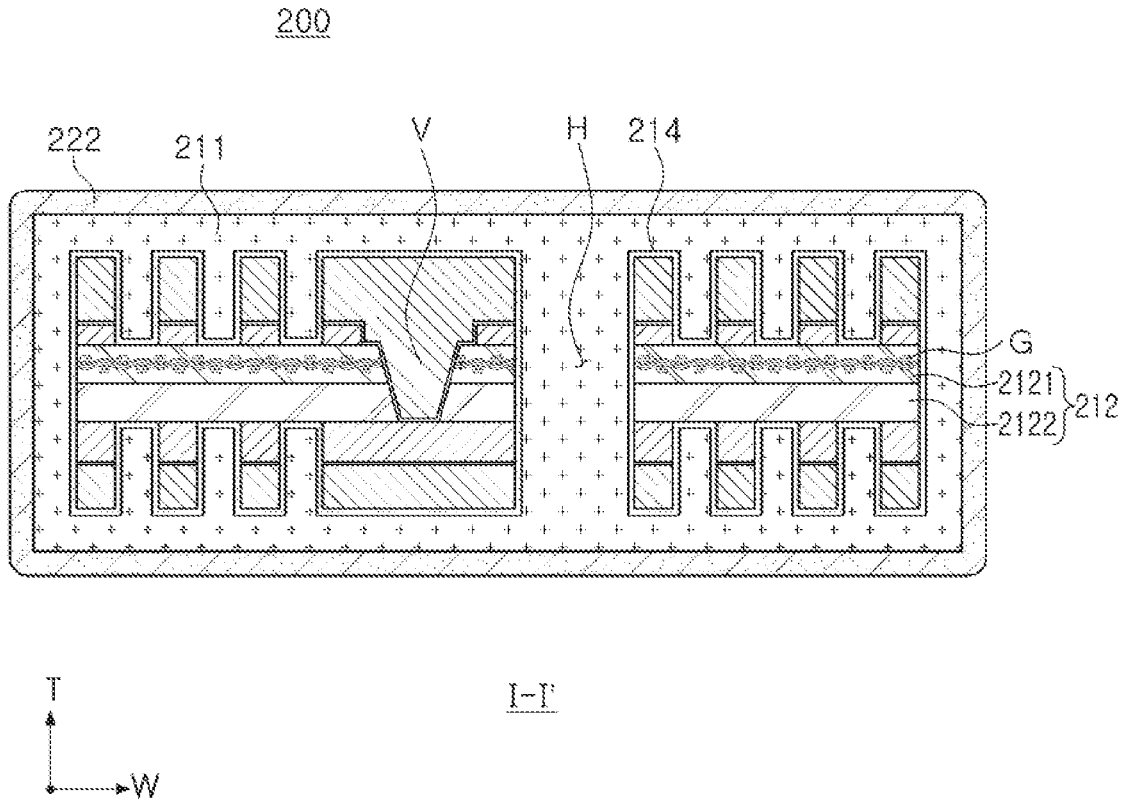
FIG. 4 is a cross-sectional view of a coil component according to a modified example of the coil component of FIGS. 1 through 3.

FIG. 4 is a cross-sectional view of a coil component 200 according to a modified example of the coil component 100 of FIGS. 1 through 3.

In the coil component 200 illustrated in FIG. 4, unlike a case in which in order to differentiate warpage properties of first and second support members from each other, the insulating resins contained therein are changed, a position of glass in a support member may be changed. For convenience of explanation, a description of overlapping configurations will be omitted, and only a description of the support member will be added.

Referring to FIG. 4, a support member 212 may include a first support member 2121 containing glass G and a second support member 2122 that does not contain glass. Based on the entire support member 212, a position at which the glass is disposed may be relatively higher than that of the center of the support member 212. The glass G may be dispersed off a central portion the support member 212 in the thickness direction. The glass G may be dispersed only in the first support member 2121 that provides an opening portion of the via hole v larger than an opening portion of the via hole provided by the second support member 2122. The reason is to prevent warpage of the support member 212 by disposing the glass G having a relatively low coefficient of thermal expansion as compared to an insulating resin in a direction opposite to a direction in which a possibility of warpage is high in the support member 212. The glass G may be dispersed to be parallel to one surface or the other surface of the support member 212. For example, an aggregate of the glass G may be disposed in a plate shape at a predetermined thickness. In this case, if necessary, a content of the glass G to the insulating resin may be suitably controlled by those skilled in the art. The glass G may be E-glass (alumino-borosilicate glass) mainly used for a printed circuit board (PCB) and having reinforcing properties or insulating properties. If necessary, the glass G may be suitably selected from NE-glass, D-glass, T-glass, S-glass, and the like, by those skilled in the art. In this case, those skilled in the art may suitably select the kind, a content, a disposition position, and the like, of the glass, depending on a degree of occurrence of warpage in consideration of a difference in thickness between the first and second seed patterns, and the like.

The coil component satisfying the requirement for a low-profile coil component may be provided by adjusting the thicknesses of the first and second seed patterns formed on one surface and the other surface of the support member in order to maintain the overall thickness of the existing CCL substrate while decreasing the thickness of the support member so as not to change the existing equipment facilities for mass production. As a result, the thickness of the support member may be significantly decreased within the coil component having the same size, such that a length of a magnetic path in the thickness direction may be decreased, and a space in which the magnetic material may be filled may be significantly increased, thereby increasing an inductance (L) value and improving DC-bias characteristics. Further, in order to solve the problem that warpage occurs at the time of removing the carrier foil used to maintain the overall thickness while adjusting the thicknesses of the first and second seed patterns, the support member may have a structure in which support members having different warpage properties are coupled to each other.

As set forth above, according to exemplary embodiments in the present disclosure, the coil component capable of solving reliability problems such as occurrence of warpage of the core, and the like, while improving inductance and Rdc characteristics by increasing the aspect ratio of the coil included in the coil component within a limited overall thickness of the coil component may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a support member including a through-hole filled with a magnetic material and a via hole filled with a conductive material, and containing an insulating material; a coil including a first coil disposed on one surface of the support member and a second coil disposed on the other surface of the support member opposing the one surface thereof; and the magnetic material encapsulating the support member and the coil; and external electrodes disposed on an external surface of the body and connected to the coil, wherein the first and second coil, respectively, comprise first and second seed patterns, and a thickness of the first seed pattern is thinner than that of the second seed pattern, and the support member includes a first support member including the one surface of the support member and a second support member including the other surface of the support member.

2. The coil component of claim 1, wherein warpage properties of the first support member are greater than those of the second support member.

3. The coil component of claim 1, wherein a coefficient of thermal expansion (CTE) of the first support member is greater than that of the second support member.

4. The coil component of claim 1, wherein the first support member includes glass, and the second support member does not contain glass.

5. The coil component of claim 4, wherein the glass is closer to the one surface of the support member than the other surface of the support member.

6. The coil component of claim 4, wherein the plate of glass extends parallel to the one surface or the other surface of the support member.

7. The coil component of claim 4, wherein a thickness of the first support member is the same as that of the second support member.

8. The coil component of claim 4, wherein the glass includes E-glass.

9. The coil component of claim 4, wherein the glass includes one or more of NE-glass, D-glass, T-glass, and S-glass.

10. The coil component of claim 1, wherein the thickness of the first seed pattern is 2 μm or more to 5 μm or less.

11. The coil component of claim 1, wherein the thickness of the second seed pattern is 12 μm or more to 18 μm or less.

12. The coil component of claim 1, wherein a total thickness of the support member is 35 μm or more to 65 μm or less.

13. The coil component of claim 1, further comprising a first base layer and a first plating layer disposed on the first seed pattern, and a second base layer and a second plating layer disposed on the second seed pattern.

14. The coil component of claim 13, wherein the first base layer encloses side surfaces and a lower surface of the via hole of the support member.

15. The coil component of claim 13, wherein the first plating layer is filled in the via hole.

16. The coil component of claim 13, wherein the first and second plating layers contain one or more of Mo, Al, Ti, Ni, and W.

17. The coil component of claim 13, wherein the first base layer is in contact with the first seed layer.

18. The coil component of claim 1, wherein the first and second support members contain an epoxy.

* * * * *